United States Patent [19]

Rodriguez

[11] Patent Number: 4,831,755

[45] Date of Patent: May 23, 1989

[54] BACK ILLUMINATED FRAME FOR TRANSLUCENT PLATES

[76] Inventor: Jose Rodriguez, 111 Palermo Ave., Coral Gables, Fla. 33134

[21] Appl. No.: 88,386

[22] Filed: Aug. 24, 1987

[51] Int. Cl.[4] ..... G09F 13/00

[52] U.S. Cl. ..... 40/152.2; 40/564; 362/27

[58] Field of Search ..... 40/564, 573, 575, 152, 40/152.1, 152.2; 362/23, 27, 33

[56] References Cited

U.S. PATENT DOCUMENTS

| | | | |
|---|---|---|---|
| 1,348,957 | 8/1920 | Pope | 40/152.2 |
| 2,677,909 | 5/1954 | Heydenryk | 40/152.2 |
| 2,806,939 | 9/1957 | Montebello . | |
| 2,906,048 | 9/1959 | Kraus | 40/152.2 |
| 3,318,032 | 5/1967 | Robinson et al. . | |
| 4,277,904 | 7/1981 | Levthesser . | |

*Primary Examiner*—Gene Mancene
*Assistant Examiner*—Wenceslao J. Contreras
*Attorney, Agent, or Firm*—J. Sanchelima

[57] ABSTRACT

A back illuminated frame for displaying translucent plates. A frame assembly with four side walls and a top wall of suitable dimensions to display the plate is covered with a back cover member that includes several lighting fixtures mounted thereon for uniform back lighting of the translucent portion of the plate being displayed. A plate support member keeps the plate being displayed in a spaced apart relationship with respect to the cover housing in between the light fixtures.

9 Claims, 2 Drawing Sheets

BACK ILLUMINATED FRAME FOR TRANSLUCENT PLATES

BACKGROUND OF THE INVENTION

1. Field of the Invention

The present invention relates to frames for translucent plates, and more particularly, to such frames that include illuminating means that uniformly project the aesthetic features of translucent plates.

2. Description of the Related Art

A number of frame designs have been designed in the past to display artistic plates. Some of these designs include lighting devices that project their light on the plates being displayed. None of these devices were designed to project a uniform light through a plate that includes a translucent area, such as the bottom of the plate.

Applicant believes that the closest reference corresponds to U.S. Pat. No. 3,318,032 issued to E. C. Robinson. However, it differs from the present invention because it does not provide illumination through a plate in a uniform manner. Inherent in Robinson's design is the rectangular arrangement of the lamps that leaves dark areas, such as in the corners.

Other references relevant to some extent to this invention are U.S. Pat. No. 2,806,939 issued to R. Montebello and U.S. Pat. No. 4,277,904 issued to Leuthesser.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a frame for holding and displaying translucent plates that provide a uniform back illumination of the plate to emphasize its aesthetic features.

It is another object of this invention to provide such an illuminated frame that can be readily mounted on the wall or placed on a flat surface by itself.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
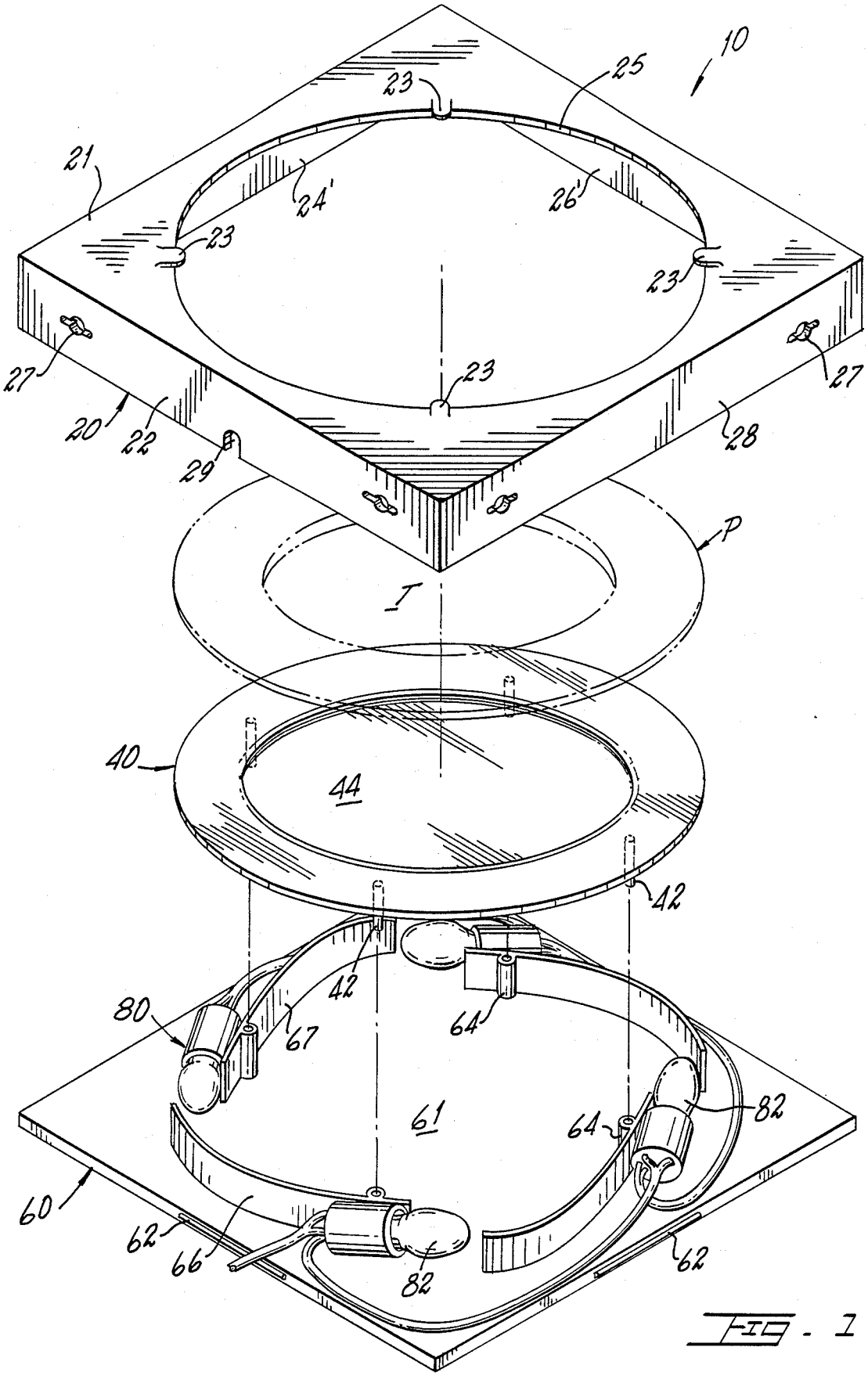
FIG. 1 represents an exploded view of a preferred embodiment in accordance with the invention.
Figure 2:
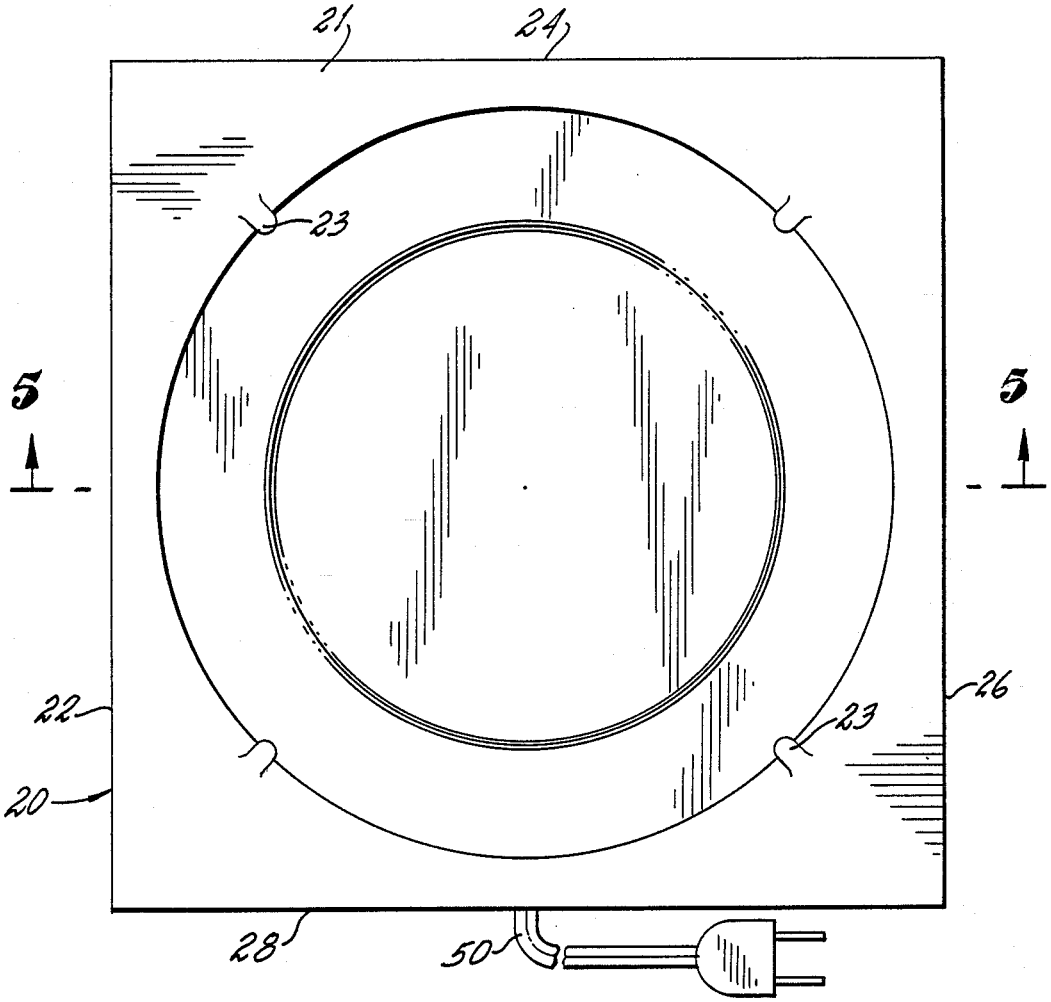
FIG. 2 shows a front view of the embodiment represented in FIG. 1.
Figure 3:
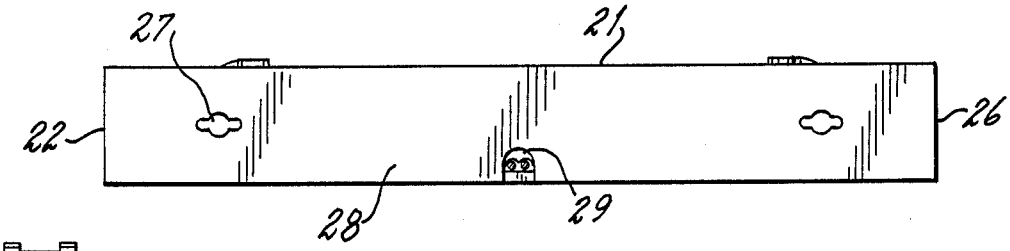
FIG. 3 illustrates a side view of the present invention.

Referring now to FIG. 1, where the present invention is generally referred to with numeral 10, it can be seen that it basically includes a frame assembly 20, plate support assembly 40, back cover assembly 60 and lighting means 80 to provide a uniform lighted background to plate P that includes translucent area T.

Figure 4:
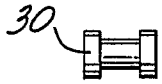
FIG. 4 is an enlarged representation of a double headed rivet member.

Frame assembly 20 has four side walls 22; 24; 26 and 28 perpendicularly disposed with respect to each other and a top wall 21 that includes an opening 25 that has the same dimensions as the plate P being displayed. Several tabs 23 are disposed around the periphery of opening 25 to prevent plate P from falling through opening 25. Several slots 27 are disposed on side walls 22; 24; 26 and 28 and in cooperation with double headed rivet members 30 keep frame assemblies together, if desired. Double headed rivet member 30 is shown in FIG. 4, in detail and enlarged. Its dimensions are such that it may be inserted through slot 27. Rivet member 30 is used to keep abutting frame members 20 close together. An opening 29 is also provided on one of the sides 22; 24; 26 and 28 in order to allow electric power conductors 50 through.

Figure 5:
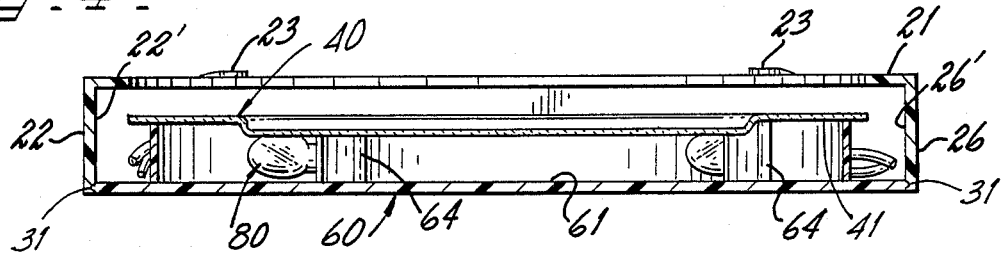
FIG. 5 shows a cross-sectional view taken along line 5—5 in FIG. 2, without the plate.

Plate support assembly 40 has substantially the shape of a ring with several pins 42 mounted on its underside 41, as shown in FIGS. 1 and 5. Plate support assembly 40 includes center translucent portion 44 that has substantially the same dimensions as the translucent portion T of plate P. As shown in FIG. 1, back cover assembly 60 has, preferably, substantially the same dimensions of top wall 21 so it can snuggly fit within the space defined by side walls 22; 24; 26 and 28. Latch members 62 are selectively located around the periphery of back cover assembly 60. Latch members 62 cooperate with latching grooves 31 on the lower inner surfaces 22'; 24'; 26' and 28' of side walls 22; 24; 26 and 28. Back cover assembly 60 includes several tubular members 64 that are perpendicularly mounted on inner surface 61. Tubular members 64 are cooperatively disposed to receive pins 42 thereby enhancing the structural integrity of the device. Several wall dividers 66, four in the preferred embodiment represented herein, are perpendicularly mounted on inner surface 61. Preferably, tubular members 64 are either rigidly attached to wall divides 66 or integrally built thereon. Wall dividers 66 are slightly curved on one end and their width is substantially similar to the height of tubular members 64. By providing this slight curve, the light emitted by light bulb 82 is captured or reflected towards the translucent portion of supporting assembly 40. Wall dividers 66 are preferably opaque, and most preferably, white so that a maximum uniform illumination is reflected to the interior of frame assembly 20. If desired, a user may color internal walls 67 so that the back illumination of the translucent area T of plate P is given some color indirectly. The different internal walls 67 may have different colors and tones depending on the user's taste and what is being displayed.

Lighting means 80 includes several (four in the embodiment shown here) lighting fixtures that may be connected in parallel like the filament light bulbs 82 represented here. Also, a battery assembly may be used instead of a power cord connected to the AC network.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A frame for plates having a translucent portion, comprising:

A. frame means having a plurality of contiguously connected side walls and a top wall having an inner and an outer surface and mounted perpendicular to said side walls, and said top wall having an opening of substantially the same dimensions as said plate and further including a plurality of tab members mounted on the periphery of said wall so that said plate is provided with support preventing it from going through said opening;

B. means for supporting said plate having substantially the same dimensions and shape as said plate including a translucent portion with dimensions substantially similar to the dimensions of said translucent portion of said plate;

C. cover means having an inner surface mounted perpendicularly to said side walls and opposite to said top wall thereby enclosing said supporting means and said plate;

D. illuminating means mounted between said cover means and said supporting means so that said illuminating means illuminate said translucent portion of said supporting means.

2. The frame set forth in claim 1 wherein said cover means includes a plurality of divider walls rigidly and perpendicularly mounted to said inner surface and so disposed around said translucent portion of said supporting means that the light from said illuminating means is reflected on said divider walls to indirectly illuminate said translucent portions of said supporting means and said plate.

3. The frame set forth in claim 2 wherein said supporting means includes an underside having a plurality of pins perpendicularly mounted thereon and said cover means includes a corresponding cooperating plurality of cylinders for receiving said pins thereby providing structural integrity to said frame.

4. The frame set forth in claim 3 wherein said illuminating means includes a plurality of light bulbs disposed between said cover means and said supporting means.

5. The frame set forth in claim 4 wherein said frame means includes a plurality of slots on said side walls and further including a plurality of double headed rivet members that are removably mounted to said slots for keeping abbutingly disposed frames in close spatial relationship with respect to each other.

6. The frame set forth in claim 5 wherein said divider walls are slightly bent to reflect the light from said light bulbs to the center of said supporting means' translucent portion.

7. The frame set forth in claim 6 wherein said side walls include respective inner surfaces having a plurality of grooves running parallel to said top wall and said cover means having a plurality of edges corresponding to the number of said side walls and in cooperation therewith including a plurality of latch members receivable within said grooves so that said cover means is removably brought together with said frame means.

8. The frame set forth in claim 7 wherein said frame means includes four side walls.

9. The frame set forth in claim 8 wherein said illuminating means includes battery means connected thereto.

* * * * *